US008454390B2

(12) United States Patent
Darr et al.

(10) Patent No.: US 8,454,390 B2
(45) Date of Patent: Jun. 4, 2013

(54) INLINE FUSE HOLDER ASSEMBLY

(75) Inventors: Matthew Rain Darr, Edwardsville, IL (US); Patrick A. Von Zur Muehlen, Wildwood, MO (US); Mengxi Zhao, St. Louis, MO (US)

(73) Assignee: Cooper Technologies Company, Houston, TX (US)

( * ) Notice: Subject to any disclaimer, the term of this patent is extended or adjusted under 35 U.S.C. 154(b) by 110 days.

(21) Appl. No.: 13/151,984

(22) Filed: Jun. 2, 2011

(65) Prior Publication Data

US 2012/0309232 A1 Dec. 6, 2012

(51) Int. Cl.
*H01R 13/68* (2006.01)

(52) U.S. Cl.
USPC ..... 439/620.28; 337/201

(58) Field of Classification Search
USPC ..... 439/620.28, 620.34, 620.26; 337/186, 337/187, 201, 227, 228, 246, 252, 186.187, 337/191, 194
See application file for complete search history.

(56) References Cited

U.S. PATENT DOCUMENTS

| | | | | | |
|---|---|---|---|---|---|
| 2,046,221 | A | * | 6/1936 | Thomas | 337/187 |
| 3,356,806 | A | * | 12/1967 | Urani | 337/192 |
| 3,518,600 | A | * | 6/1970 | Urani | 337/201 |
| 3,778,741 | A | * | 12/1973 | Schmidt, Jr. | 337/201 |
| 4,734,059 | A | * | 3/1988 | Melugin | 439/620.28 |
| 4,909,761 | A | * | 3/1990 | Muguira | 439/620.29 |
| 5,018,991 | A | * | 5/1991 | Katz et al. | 439/620.28 |
| 5,648,749 | A | * | 7/1997 | Lin et al. | 337/205 |
| 5,888,098 | A | * | 3/1999 | Cheng et al. | 439/620.28 |

FOREIGN PATENT DOCUMENTS

| | | | |
|---|---|---|---|
| EP | 2112675 | A2 | 10/2009 |
| FR | 1264914 | A | 6/1961 |
| GB | 830163 | A | 3/1960 |

OTHER PUBLICATIONS

International Search Report and Written Opinion of International Application No. PCT/US2012/038827; 19 pages; Dec. 4, 2012.

* cited by examiner

*Primary Examiner* — Gary F. Paumen
(74) *Attorney, Agent, or Firm* — Armstrong Teasdale LLP

(57) ABSTRACT

An inline fuse holder assembly encloses a fuse assembly including a fuse, and first and second wire connectors at respective first and second longitudinal ends of the fuse assembly. The inline fuse holder assembly includes first and second components including respective first and second connectors. The first and second connectors include mateable, non-releasable connection components configured to connect the first and second components to one another and form a substantially waterproof, non-releasable connection upon connection. The first and second components together define an enclosure for enclosing an entirety of the fuse assembly when the first and second fuse holder components are connected to one another.

27 Claims, 7 Drawing Sheets

INLINE FUSE HOLDER ASSEMBLY

BACKGROUND OF THE INVENTION

The field of the invention relates generally to an inline fuse holder assembly.

Fuses are widely used as overcurrent protection devices to prevent costly damage to electrical circuits. Fuse terminals typically form an electrical connection between an electrical power source and an electrical component or a combination of components arranged in an electrical circuit. One or more fusible links or elements, or a fuse element assembly, is connected between the fuse terminals, so that when electrical current through the fuse exceeds a predetermined limit, the fusible elements melt and open one or more circuits through the fuse to prevent electrical component damage.

A variety of different types of fuse holders are known to provide electrical interfaces for overcurrent protection fuses. One type of fuse holder is an inline fuse holder that electrically connects a ferrule fuse within an electrical system. Among several applications, the inline fuse holder may be used in solar photovoltaic systems. The inline fuse holder assembly typically comprises a holder body having two pieces that releasably attach to one another using a compression nut and define an interior space for receiving the fuse. In some circumstance, it may be rather tedious and time consuming for a technician in the field to have to tighten the compression nut using a tool in order to connect the two pieces of the fuse holder assembly.

In addition, at least two contacts of the inline fuse electrically connect to the terminals of the fuse when the fuse is received in the fuse holder body. The contacts include wire connectors that extend outside the holder body. The wire connectors are connectable to (e.g., crimped onto) wires that are electrically connected to the electrical system. These connections between the wire connectors and the wires are exposed to the environment. Thus, a pair of insulating boots must be slid over the inline fuse holder (as generally known in the art) to cover and insulate the fuse holder body and these connections.

BRIEF DESCRIPTION OF THE DRAWINGS

Non-limiting and non-exhaustive embodiments are described with reference to the following Figures, wherein like reference numerals refer to like parts throughout the various drawings unless otherwise specified.

DETAILED DESCRIPTION OF THE DRAWINGS

Figure 1:
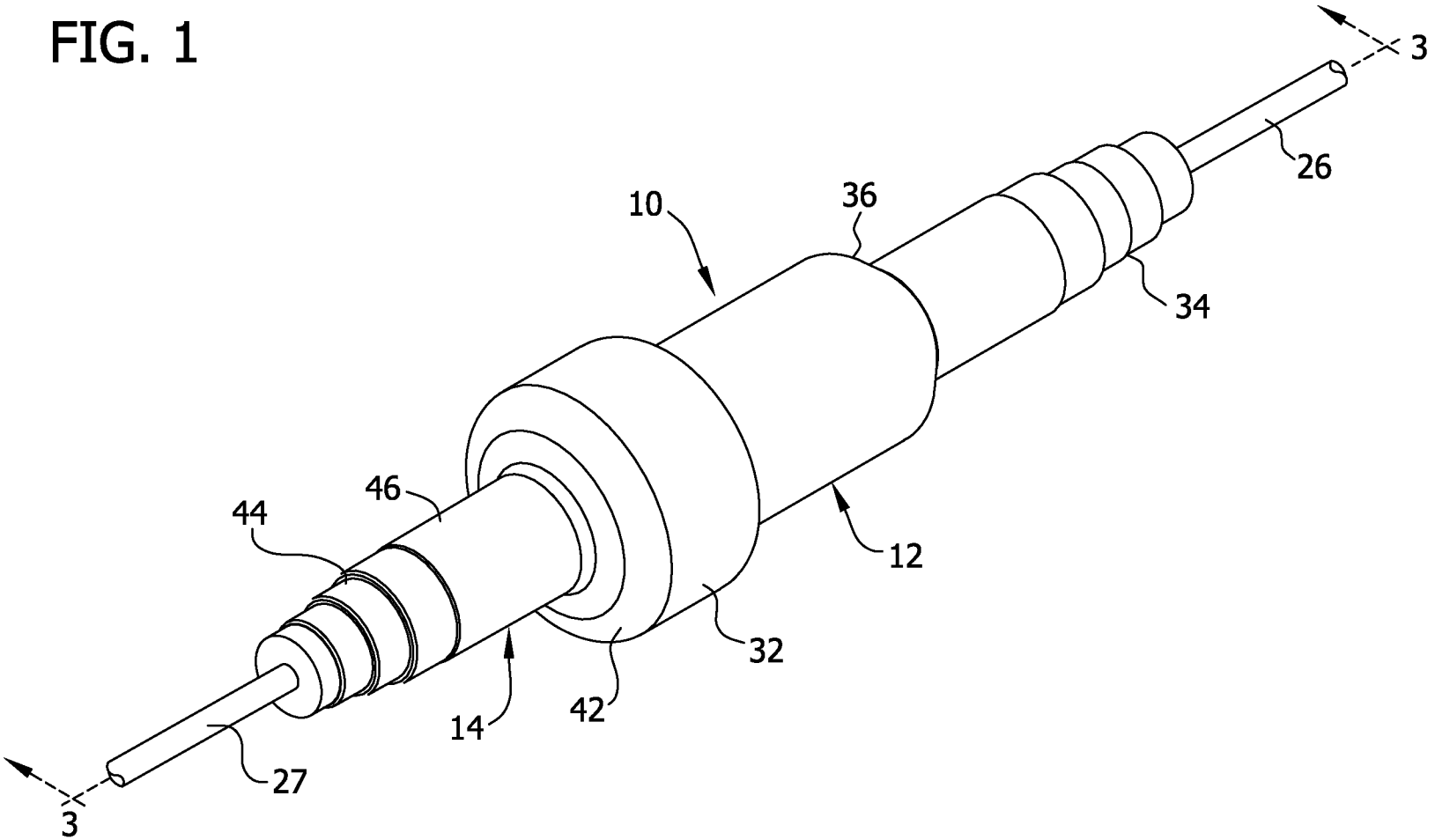
FIG. 1 is a perspective of an embodiment of an assembled inline fuse holder assembly enclosing a fuse assembly, with first and second wires connected to the fuse assembly extending outside the inline fuse holder assembly.
Figure 2:
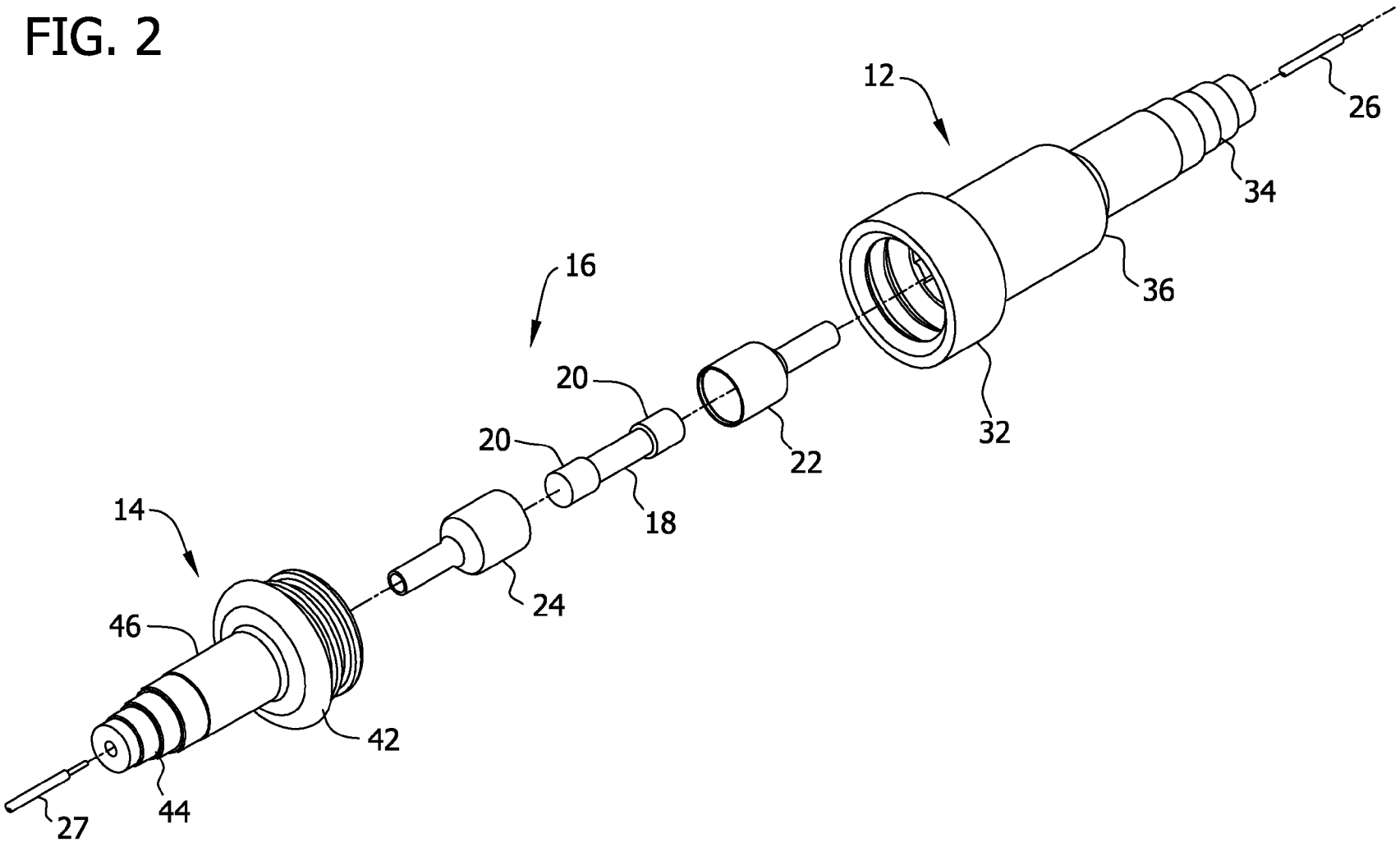
FIG. 2 is an exploded view of the inline fuse holder assembly of FIG. 1.

Referring now to drawings, one example of an inline fuse holder assembly is generally indicated at reference numeral 10. As seen in FIGS. 1 and 2, the fuse holder assembly 10 comprises first and second components, generally indicated at 12, 14, respectively, that are non-releasably connectable to one another to enclose a fuse assembly, generally indicated at 16, and electrically connect the enclosed fuse assembly within an electrical circuit or electrical grid or other electrical device or system that requires a fuse, such as a solar photovoltaic system. As explained in more detail below, in one embodiment the inline fuse holder assembly 10 may also be configured to be substantially waterproof to inhibit water and other liquid from entering the fuse holder assembly and contacting the fuse assembly 16. The illustrated inline fuse holder assembly 10 is a one-pole, non-breakaway inline fuse holder assembly, although it is understood that the fuse holder assembly may be, among others, a multiple pole (e.g., double pole) fuse holder assembly, or possibly other types of fuse holder assembly.

Figure 3:
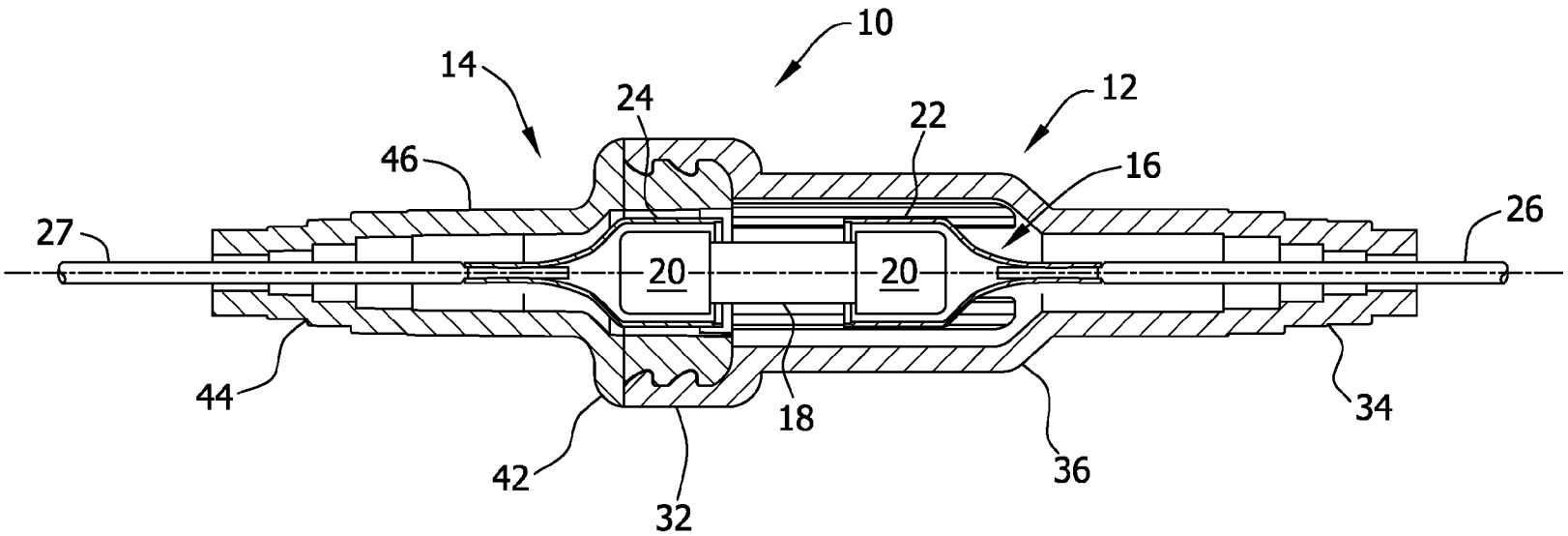
FIG. 3 is longitudinal section of the inline fuse holder assembly of FIG. 1 taken along the line 3-3.
Figure 4:
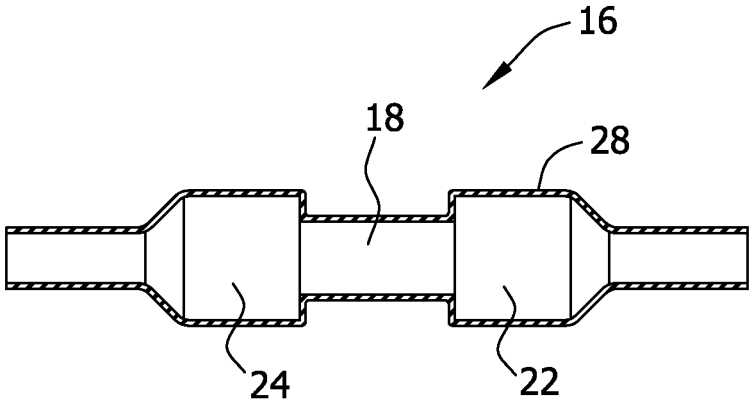
FIG. 4 is a front elevation of an alternative example of a fuse assembly, including a substantially waterproof, dielectric layer surrounding the fuse assembly shown in section.
Figure 5:
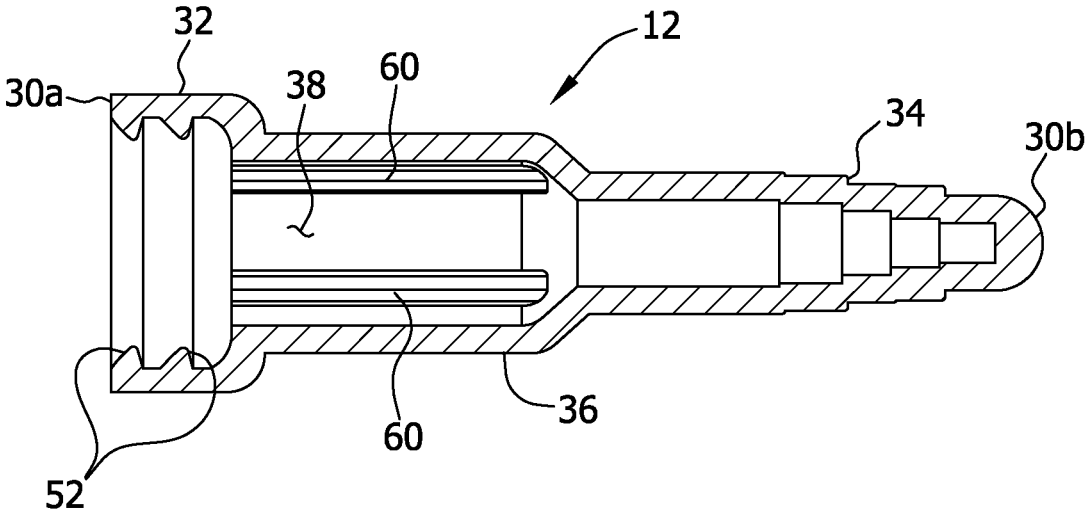
FIG. 5 is a longitudinal section of a first fuse holder component of the inline fuse holder assembly, with a first wire receiving portion being uncut.

Referring to FIGS. 2-4, the fuse assembly 16, with which the illustrated inline fuse holder assembly 10 is configured for use, includes a fuse 18, of the type generally known as a ferrule fuse having ferrule terminals 20 at opposite longitudinal ends of the fuse, and first and second wire connectors 22, 24 attached to the respective ferrule terminals and configured for electrically connecting first and second wires 26, 27 to the fuse. The first and second wires 26, 27 may be lead wires that are connectable to the electrical system after assembling the fuse holder assembly 10, or the first and second wires may be wires that are already part of the electrical system. As used herein, the term "wire" means an electrically conductive component, as commonly understood to by one skilled in the art.

The wire connectors 22, 24 may be crimped over the ferrule terminals 20, using a suitable crimping tool (e.g., Sta-Kon® Comfort Crimp® Compression Tool by Thomas & Betts), to make a non-releasable connection. The wire connectors 22, 24 may be attached to the ferrule terminals 20 in other ways. In another embodiment, the ferrule terminals 20 and the wire connectors 22, 24 may be integrally formed as single, one-piece components. In one non-limiting example, the wire connectors 22, 24 are configured for crimping, using a suitable crimping tool (e.g., Sta-Kon® Comfort Crimp® Compression Tool by Thomas & Betts), to connect the wires 26, 27 inside the wire connectors. The wire connectors 22, 24 may be formed from tin plated copper or other electrically conductive material. It is understood that wire connectors 22, 24 may be of other types and have other configurations without departing from the scope of the present invention. In one example, the fuse 18 may be a photovoltaic (PV) fuse for use in solar panel applications. One suitable, non-limiting example are PV fuses sold by Cooper Bussmann, St. Louis, Mo., USA and more specifically their fuses having PV series product numbers, such as product number PV-15A10F and similar fuses.

In one example (FIG. 4), the fuse assembly 16 also includes a substantially waterproof, dielectric outer layer 28 surrounding the fuse 18 and the wire connectors 22, 24. The outer layer 28 may be a heat shrink, such as a nylon or polyolefin heat shrink, or may be made from other suitable material. The outer layer 28 inhibits water and other liquid from contacting the fuse 18 and the wire connectors 22, 24. In effect, the outer layer 28 is a precautionary measure and safeguard in case any water or liquid should enter the fuse holder assembly 10. It is understood that the fuse assembly 16 may not include the outer layer 28 without departing from the scope of the present invention.

Referring to FIGS. 1-3 and 5, the first component 12 of the illustrated inline fuse holder assembly 10 is generally elongate and has an open first longitudinal end 30*a*, and an opposite second longitudinal end 30*b*. The first component 12 generally includes a first connector 32 adjacent the first longitudinal end 30*a*, a first wire receiving portion 34 adjacent the second longitudinal end 30*b*, and a first body portion 36 intermediate the first connector and the first wire receiving portion. A first fuse assembly-receiving cavity 38 extends longitudinally from the first longitudinal end 30*a* toward the closed longitudinal end 30*b* and terminates before the first wire receiving portion 34. As explained in more detail below, the first longitudinal end 30*a* and the first fuse assembly-receiving cavity 38 are sized and shaped such that the fuse assembly 16 can be inserted through the first longitudinal end and into the first fuse assembly-receiving cavity.

Referring to FIGS. 1-3 and 7, the second component 14 of the illustrated inline fuse holder assembly 10 is generally elongate and has an open first longitudinal end 40*a*, and an opposite second longitudinal end 40*b*. The second component 14 generally includes a second connector 42 adjacent the first longitudinal end 40*a*, a second wire receiving portion 44 adjacent the second longitudinal end 40*b*, and a second body portion 46 intermediate the second connector and the second wire receiving portion. A second fuse assembly-receiving cavity 48 extends longitudinally from the first longitudinal end 40*a* toward the second longitudinal end 40*b* and terminates before the second wire receiving portion 44. As explained in more detail below, the first longitudinal end 40*a* and the second fuse assembly-receiving cavity 48 are sized and shaped such that the fuse assembly 16 can be inserted through the first longitudinal end and into the second fuse assembly-receiving cavity.

Referring to FIGS. 1-3, in the illustrated embodiment the first and second fuse holder components 12, 14 are non-releasably connectable to one another by mating the first and second connectors 32, 42. The first connector 32 is a female (i.e., hub) component and the second connector 42 is a male (i.e., plug) component, although it is understood that in other embodiments the first component may be a male component and the second component may be a female component. The first and second connectors 32, 42 of the illustrated embodiment include mateable snap-fit components 52, 54, respectively, although the connectors may include other types of connection components without departing from the scope of the present invention. More specifically, the illustrated snap-fit component 52 of the first connector 32 includes two internal annular barbs that are resiliently deflectable and spaced apart longitudinally. The illustrated snap-fit component 54 of the second connector 42 includes two annular grooves that are spaced apart longitudinally and are configured for receiving the annular barbs. In other embodiments, the snap-fit components 52, 54 may be other types of snap-fit components.

Upon mating of the first and second connectors 32, 42, the annular barbs 52 resiliently deflect and then rebound (i.e., "snap") into the corresponding annular grooves 54 to form a non-releasable connection. In other words, the connection between the first and second connectors 32, 42 is non-releasable in and of itself, and it is not necessary to apply other components (e.g., a lock) or materials (e.g., adhesive) to make the connection non-releasable, although such components (e.g., a lock) or materials (e.g., adhesive) may be used as an additional safeguard. The first and second connectors 32, 42 may be configured in other ways such that a non-releasable connection is formed upon connection of the first and second connectors.

In one embodiment, the connection between the first and second connectors 32, 42 is also substantially waterproof to inhibit water and other contaminants from entering into the fuse holder assembly 10. For example, in the illustrated embodiment the annular barbs 52 do not completely rebound to their at-rest positions when they snap into the corresponding annular grooves 54. As such, the annular barbs 52, when received in the corresponding annular grooves 54, apply a constant compressive force against walls of the second connector 42. The compressive force between the annular barbs 52 and the walls of the second connector 42 are of a sufficient magnitude to inhibit water and other contaminants from entering therebetween. As can be understood, the engagement between the snap-fit components 52, 54 is substantially waterproof upon mating of the first and second connectors 32, 42. Thus, the snap-fit components 52, 54 themselves form a substantially waterproof seal upon mating of the first and second connectors 32, 42. In other words, the connection between the first and second connectors 32, 42 is substantially waterproof in and of itself, and it is not necessary to apply other components (e.g., a waterproof seal) or materials (e.g., waterproof adhesive) to make the connection substantially waterproof, although such components (e.g., a waterproof seal) or materials (e.g., waterproof adhesive) may be used as an additional safeguard. The first and second connectors 32, 42 may be configured in other ways such that a substantially waterproof connection is formed upon connection of the first and second connectors.

As can be seen best in FIG. 3, in the illustrated embodiment the first fuse holder component 12 has a length that is greater than a length of the second fuse holder component 14. In particular, a length of the first fuse assembly-receiving cavity 38 is greater than a length of the second fuse assembly-receiving cavity 48. Moreover, for reasons explained below when describing the assembly of the fuse holder assembly 10, the length of a portion of the first fuse assembly-receiving cavity 38 defined by the first body portion 36 is greater than 50% of the length of the fuse assembly 16. When the fuse holder assembly 10 is assembled with the fuse assembly 16 enclosed inside, the first fuse assembly-receiving cavity 38 accounts for more than 50% of a length of an enclosure defined by the first and second fuse assembly-receiving cavity. It is understood that aspects of the first and second components may have other relative lengths and sizes without departing from the scope of the present invention.

Referring to FIGS. 1-3, each of the first and second wire receiving portions 34, 44 are configured to receive the respective first and second wires 26, 27 such that when assembled, the first and second wires 26, 27 are connected to the fuse assembly 16 inside the fuse holder 10 and the wires 26, 27 extend outside the fuse holder assembly 10 through the respective second longitudinal ends 30*b*, 40*b*. In the illustrated embodiment, the wire receiving portions 34, 44 have stepped internal diameters to accommodate corresponding wires of different gauges for using the fuse holder assembly 10 in different applications. In one non-limiting example, each of the first and second wire receiving portions 34, 44 is capable of accommodating a wire 26, 27 having a gauge that is any one of 14 AWG, 12 AWG, 10 AWG, and 8 AWG. External stepped diameters and other indicia indicate the locations where the wire receiving portions 34, 44 should be cut in order to accommodate a selected wire gauge. In one example, the stepped internal diameters are configured to form a substantially waterproof seal around the respective first and second wires 26, 27. Thus, the wire receiving portions 34, 44 and the respective first and second wires 26, 27 form substantially waterproof seals, in and of themselves, and it is not necessary to apply other components (e.g., a waterproof seal) or materials (e.g., waterproof adhesive) to the wire receiving portions or the wires, although such components (e.g., a waterproof seal) or materials (e.g., waterproof adhesive) may be used as an additional safeguard. Other ways of substantially waterproofing the first and second wire receiving portions 34, 44 do not depart from the scope of the present invention.

In one embodiment, each of the first and second fuse holder components 12, 14 may be formed as a single, one-piece component, such as by molding. The first and second fuse holder components 12, 14 may be formed from a suitable substantially waterproof, electrically insulating material, such as a suitable plastic material, and may be molded or constructed in other ways. In one non-limiting example, the first and second fuse holder components 12, 14 may be a suitable thermoplastic rubber (also called "thermoplastic elastomer"), such as a suitable thermoplastic rubber having a hardness of about 50 Shore A to about 75 Shore A. For example, a suitable thermoplastic rubber is sold by Exxon Mobil Corporation, New Jersey, USA, and sold under the mark Santoprene®. In one non-limiting example, the first and second fuse holder components 12, 14 may be made from Santoprene® 101-64 having a hardness of about 69 Shore A.

Figure 6:
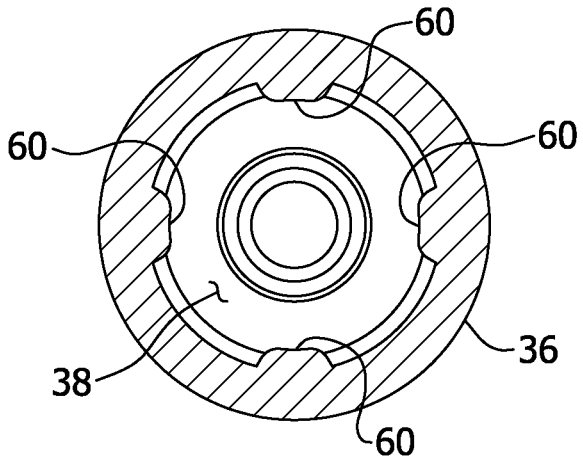
FIG. 6 is a cross section of the first fuse holder component taken through a first body portion thereof.
Figure 7:
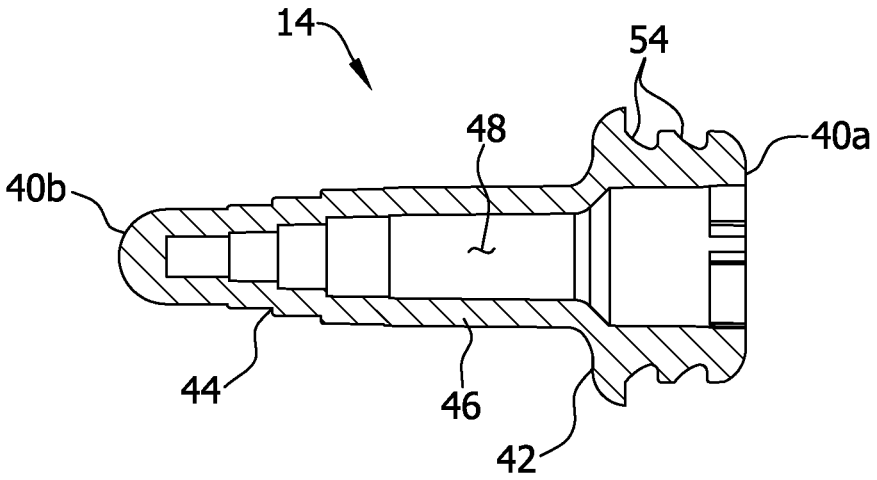
FIG. 7 is a longitudinal section of a second fuse holder component of the inline fuse holder assembly, with a second wire receiving portion being uncut.

In such an example, such as an example where the first and second fuse holder components 12, 14 are generally non-rigid (e.g., formed from a thermoplastic rubber), at least one of the first and second components 12, 14 may include a plurality of internal, longitudinal ribs 60 (FIGS. 5 and 6) projecting radially inward into the corresponding fuse assembly-receiving cavity 38, 48. The internal, longitudinal ribs 60 provide rigidity to the fuse holder assembly 10 in order to protect the fuse 18 inside the holder assembly 10. In particular, the ribs 60 absorb shear and bending forces acting on the fuse holder assembly 10. The longitudinal ribs 60 may also be configured to grip the fuse assembly 16 when the fuse assembly 16 is inserted in one of the first and second components 12, 14 to inhibit the fuse assembly 16 from slipping out of the corresponding component 12, 14. In the illustrated embodiment, the first body portion 36 of the first fuse holder component 12 includes the internal longitudinal ribs 60 because the majority of the fuse assembly 16 is received in the first body portion 36 and because it may be preferred to insert the fuse assembly 16 into the first fuse holder component 12 before inserting the fuse assembly 16 into the second fuse holder component 14, as explained in more detail below when discussing an exemplary assembly of the fuse holder assembly 10. The internal longitudinal ribs 60, of which there are four, are spaced apart 90 degrees circumferentially (i.e., equidistantly) around the interior surface of the first body portion 36. It is understood that fuse holder assembly 10 may include any number of longitudinal ribs 60, or the fuse holder assembly may not include the longitudinal ribs without departing from the scope of the present invention.

In a non-limiting example of assembly, the wire connectors 22, 24 are crimped onto the respective ferrule terminals 20 of the fuse 18 to form the fuse assembly 16. Optionally, the waterproof, dielectric outer layer 28 (e.g., heat shrink) is applied to the fuse assembly 16 to substantially encase the fuse assembly 16. The fuse assembly 16, which may include the outer layer 28, may be sold as a pre-assembled component and delivered to the field in this pre-assembled configuration for use with the fuse holder assembly 10. Alternatively, the fuse assembly 16 may be sold as separate parts (e.g., separate fuses 18, wire connectors 22, 24, and outer layers 28) and assembled by the user, such as a technician, in the field.

With the fuse assembly 16 assembled (e.g., pre-assembled), the wire receiving portions 34, 44 of the respective first and second fuse holder components 12, 14 are cut transversely at the selected stepped external diameters corresponding to the selected gauges of the first and second wires 26, 27. The first and second wires 26, 27 are then inserted through the newly formed openings and into the respective first and second wire receiving portions 34, 44. The first and second wires 26, 27 are pulled through the open longitudinal ends 30*a*, 40*a* of the respective first and second fuse holder components 12, 14, and then the first and second wire connectors 22, 24 are crimped onto the respective first and second wires 26, 27.

In one example, the first wire 26 is attached to the first wire connector 22 before connecting the second wire 27 to the second wire connector 24. After connecting the first wire 26 to the first wire connector 22, the fuse assembly 16 is inserted into the first fuse holder component 12. Because, in one example, the first fuse holder component 12 has the relatively long fuse assembly-receiving cavity 38 and the plurality of internal longitudinal ribs 60, the fuse 18 is held securely and safely in the first fuse holder component 12 as second wire 27 is being connected to the second wire connector 24.

With the first and second wires 26, 27 connected to the fuse assembly 16, the first and second connectors 32, 42 are mated together, such as by engaging the snap-fit components 52, 54, to form a non-releasable, substantially waterproof connection. In one example, where the first and second wires 26, 27 are already connected to the electrical system, the installation is complete after connecting the first and second fuse holder components 12, 14 together. In another example, where the first and second wires 26, 27 are lead wires, the inline fuse holder assembly 10, with the fuse assembly 16 enclosed therein, is then electrically connected to an electrical system by connecting the first and second wires 26, 27 to the electrical system. It is contemplated that the first and second fuse holder components 12, 14 may be sold together and delivered to the field for assembly with the fuse assembly 12. It is also contemplated that the completed assembly (i.e., the fuse holder assembly 10, the fuse assembly 16 enclosed therein, and the first and second wires 26, 27 connected to the fuse assembly) may be pre-assembled as a single component and delivered to field for installation by connecting the first and second wires 26, 27 to the system.

In a non-limiting example of replacing the fuse assembly 16, for whatever reason, the entire completed assembly (i.e., the fuse holder assembly 10, the fuse assembly 16 enclosed therein, and the first and second wires 26, 27 connected to the fuse assembly) must be replaced because the fuse holder components 12, 14 are non-releasably connected.

An inline fuse holder is disclosed. The inline fuse holder assembly is for enclosing a fuse assembly including a fuse, and first and second wire connectors at respective first and second longitudinal ends of the fuse assembly. The inline fuse holder assembly includes a first fuse holder component having an open first longitudinal end and a second longitudinal end. The first component includes a first connector adjacent the first longitudinal end of the first fuse holder component, a first wire receiving portion adjacent the second longitudinal end of the first fuse holder component, and a first body portion intermediate the first connector and the first wire receiving portion. The first fuse holder component defines a first fuse assembly-receiving cavity, extending from the first longitudinal end toward the second longitudinal end and terminating before the first wire sealing portion, for receiving the first longitudinal end of the fuse assembly through the first longitudinal end of the first fuse holder component. The first wire receiving portion is configured for receiving a first wire connectable to the first wire connector when the fuse assembly is received in the fuse assembly-receiving cavity. A second fuse holder component has an open first longitudinal end and a second longitudinal end, the second component includes a second connector adjacent the first longitudinal end of the second fuse holder component, a second wire receiving portion adjacent the second longitudinal end of the second fuse holder component, and a second body portion intermediate the second connector and the second wire receiving portion. The second fuse holder component defines a second fuse assembly-receiving cavity, extending from the first longitudinal end toward the second longitudinal end and terminating before the second wire sealing portion, for receiving the second longitudinal end of the fuse assembly through the first longitudinal end of the second fuse holder component. The second wire receiving portion is configured for receiving a second wire connectable to the second wire connector when the fuse assembly is received in the fuse assembly-receiving cavity. The first and second connectors include mateable, non-releasable connection components configured to connect the first and second fuse body portions to one another and form a substantially waterproof, non-releasable connection upon connection of the first and second fuse body portions, wherein the first and second fuse assembly-receiving cavities together define an enclosure for enclosing an entirety of the fuse assembly when the first and second fuse holder components are connected to one another.

Optionally, the mateable, non-releasable connection components may comprise snap-fit components. The snap-fit components may comprise annular snap-fit components. Each of the first and second components may be a single, one-piece structure formed from thermoplastic rubber. Each of the first and second components may be formed from thermoplastic rubber having a hardness from about 50 Shore A to about 75 Shore A.

Moreover, the first wire receiving portion may configured for forming a substantially waterproof seal around the first wire when the first wire is inserted in the first wire receiving portion, and the second wire receiving portion may be configured for forming a substantially waterproof seal around the second wire when the second wire is inserted in the second wire receiving portion. Each of the first and second wire receiving portions may be configurable to selectively accommodate wires of different gauges.

A majority of a length of the enclosure may be defined by the first fuse assembly-receiving cavity. At least one of the first and second fuse holder components may include a plurality of internal, longitudinal ribs extending radially into the corresponding one of the first and second fuse assembly-receiving cavities.

The inline fuse holder assembly may be in combination with the fuse assembly including the fuse, and the first and second wire connectors at the respective first and second longitudinal ends of the fuse assembly. The fuse holder assembly may be in further combination with the first and second wires, wherein first and second connectors are connected to one another to form a substantially waterproof, non-releasable connection, and the fuse assembly is enclosed in the enclosure, wherein the first and second wires are electrically connected to the respective first and second wire connectors of the fuse assembly and extend through the respective first and second wire receiving portions to outside the respective first and second fuse holder components. The first wire receiving portion may form a substantially waterproof seal around the first wire, and the second wire receiving portion may form a substantially waterproof seal around the second wire. The inline fuse holder assembly may further includes a substantially waterproof, dielectric layer around the fuse and the wire connectors.

A method of assembling together a fuse assembly and fuse holder assembly is disclosed. The method includes inserting a first longitudinal end of the fuse assembly into a first fuse holder component of the fuse holder assembly, wherein the first fuse holder component is of a single, one-piece construction; and connecting a first connector of the first fuse holder component with a second connector of a second fuse holder component after inserting a first end of the fuse assembly, wherein the second fuse holder component is of a single, one-piece construction. A substantially non-releasable, waterproof connection between the first and second connectors is formed and entirety of the fuse assembly is enclosed in an enclosure defined by the first and second fuse holder components upon said connecting a first connector of the first fuse holder component with a second connector of a second fuse holder component.

Optionally, each of the first and second fuse holder components may be formed from thermoplastic rubber. The method may also include inserting a first wire into a first wire receiving portion of the first fuse holder component, wherein a portion of the first wire extends outside the first fuse holder component through a second longitudinal end of the first fuse holder component; connecting the first wire to a first wire connector of the first fuse assembly, wherein the first wire connector is disposed at a first longitudinal end of the fuse; inserting the second wire into a second wire receiving portion of the second fuse holder component, wherein a portion of the second wire extends outside the second fuse holder component through a second longitudinal end of the second fuse holder component; andconnecting the second wire to a second wire connector of the first fuse assembly, wherein the second wire connector is disposed at a second longitudinal end of the fuse.

Connecting the first wire to a first wire connector of the first fuse assembly may include crimping said first wire connector over said first wire, and connecting the second wire to a second wire connector of the second fuse assembly may include crimping said second wire connector over second first wire.

Another embodiment of an inline fuse holder assembly is also disclosed. The inline fuse holder was for enclosing a fuse assembly including a fuse, and first and second wire connectors at respective first and second longitudinal ends of the fuse assembly. The inline fuse holder includes a first fuse holder component having an open first longitudinal end and a second longitudinal end. The first component includes a first connector adjacent the first longitudinal end of the first fuse holder component, a first wire receiving portion adjacent the second longitudinal end of the first fuse holder component, and a first body portion intermediate the first connector and the first wire receiving portion. The first fuse holder component defines a first fuse assembly-receiving cavity, extending from the first longitudinal end toward the second longitudinal end and terminating before the first wire sealing portion, for receiving the first longitudinal end of the fuse assembly through the first longitudinal end of the first fuse holder component. The first wire receiving portion is configured for receiving a first wire connectable to the first wire connector when the fuse assembly is received in the fuse assembly-receiving cavity. A second fuse holder component has an open first longitudinal end and a second longitudinal end. The first component includes a second connector adjacent the first longitudinal end of the second fuse holder component, a second wire receiving portion adjacent the second longitudinal end of the second fuse holder component, and a second body portion intermediate the second connector and the second wire receiving portion. The second fuse holder component defines a second fuse assembly-receiving cavity, extending from the first longitudinal end toward the second longitudinal end and terminating before the second wire sealing portion, for receiving the second longitudinal end of the fuse assembly through the first longitudinal end of the second fuse holder component. The second wire receiving portion is configured for receiving a second wire connectable to the second wire connector when the fuse assembly is received in the fuse assembly-receiving cavity. Each of the first and second fuse holder components is of a single, one-piece construction of thermoplastic rubber, and at least one of the first and second fuse holder components includes a plurality of internal longitudinal ribs projecting into the corresponding one of the first and second fuse assembly-receiving cavity.

A fuse assembly formed as a single unit for use with a fuse holder assembly is also disclosed. The fuse assembly includes a ferrule fuse having opposite first and second longitudinal ends; a first wire connector at the first longitudinal end of the ferrule fuse for connecting the ferrule fuse to a first wire; a second wire connector at the second longitudinal end of the ferrule fuse for connecting the ferrule fuse to a second wire; and a substantially waterproof, dielectric outer layer surrounding the ferrule fuse and the first and second wire connectors.

Optionally, the ferrule fuse may include first and second ferrule terminals, and the first and second wire connectors may be crimped onto the respective first and second ferrule terminals and non-releasable connected thereto. The outer layer may comprise heat shrink.

What is claimed is:

1. An inline fuse holder assembly for enclosing a fuse assembly including a fuse, and first and second wire connectors at respective first and second longitudinal ends of the fuse assembly, the inline fuse holder assembly comprising:

a first fuse holder component having an open first longitudinal end and a second longitudinal end, the first component including:

a first connector adjacent the first longitudinal end of the first fuse holder component, a first wire receiving portion adjacent the second longitudinal end of the first fuse holder component, and a first body portion intermediate the first connector and the first wire receiving portion, wherein the first fuse holder component defines a first fuse assembly-receiving cavity, extending from the first longitudinal end toward the second longitudinal end and terminating before the first wire sealing portion, for receiving the first longitudinal end of the fuse assembly through the first longitudinal end of the first fuse holder component, wherein the first wire receiving portion is configured for receiving a first wire connectable to the first wire connector when the fuse assembly is received in the fuse assembly-receiving cavity;

a second fuse holder component having an open first longitudinal end and a second longitudinal end, the second component including:

a second connector adjacent the first longitudinal end of the second fuse holder component, a second wire receiving portion adjacent the second longitudinal end of the second fuse holder component, and a second body portion intermediate the second connector and the second wire receiving portion, wherein the second fuse holder component defines a second fuse assembly-receiving cavity, extending from the first longitudinal end toward the second longitudinal end and terminating before the second wire sealing portion, for receiving the second longitudinal end of the fuse assembly through the first longitudinal end of the second fuse holder component, wherein the second wire receiving portion is configured for receiving a second wire connectable to the second wire connector when the fuse assembly is received in the fuse assembly-receiving cavity; and the first and second connectors including mateable, non-releasable connection components configured to connect the first and second fuse body portions to one another and form a substantially waterproof, non-releasable connection upon connection of the first and second fuse body portions, wherein the first and second fuse assembly-receiving cavities together define an enclosure for enclosing an entirety of the fuse assembly when the first and second fuse holder components are connected to one another.

2. The inline fuse holder assembly set forth in claim 1, wherein the mateable, non-releasable connection components comprise snap-fit components.

3. The inline fuse holder assembly set forth in claim 2, wherein the snap-fit components comprise annular snap-fit components.

4. The inline fuse holder assembly set forth in claim 1, wherein each of the first and second components is a single, one-piece structure formed from thermoplastic rubber.

5. The inline fuse holder assembly set forth in claim 4, wherein each of the first and second components is formed from thermoplastic rubber having a hardness from about 50 Shore A to about 75 Shore A.

6. The inline fuse holder assembly set forth in claim 1, wherein the first wire receiving portion is configured for forming a substantially waterproof seal around the first wire when the first wire is inserted in the first wire receiving portion, and wherein the second wire receiving portion is configured for forming a substantially waterproof seal around the second wire when the second wire is inserted in the second wire receiving portion.

7. The inline fuse holder assembly set forth in claim 6, wherein each of the first and second wire receiving portions is configurable to selectively accommodate wires of different gauges.

8. The inline fuse holder assembly set forth in claim 1, wherein a majority of a length of the enclosure is defined by the first fuse assembly-receiving cavity.

9. The inline fuse holder assembly set forth in claim 1, wherein at least one of the first and second fuse holder components includes a plurality of internal, longitudinal ribs extending radially into the corresponding one of the first and second fuse assembly-receiving cavities.

10. The inline fuse holder assembly set forth in claim 1, in combination with the fuse assembly including the fuse, and the first and second wire connectors at the respective first and second longitudinal ends of the fuse assembly.

11. The inline fuse holder assembly set forth in claim 10, in further combination with the first and second wires, wherein first and second connectors are connected to one another to form a substantially waterproof, non-releasable connection, and the fuse assembly is enclosed in the enclosure, wherein the first and second wires are electrically connected to the respective first and second wire connectors of the fuse assembly and extend through the respective first and second wire receiving portions to outside the respective first and second fuse holder components.

12. The inline fuse holder assembly set forth in claim 11, wherein the first wire receiving portion forms a substantially waterproof seal around the first wire, and wherein the second wire receiving portion forms a substantially waterproof seal around the second wire.

13. The inline fuse holder assembly set forth in claim 11, wherein the fuse assembly further includes a substantially waterproof, dielectric layer around the fuse and the wire connectors.

14. The inline fuse holder assembly set forth in claim 13, wherein the substantially waterproof, dielectric outer layer comprises heat shrink.

15. A method of assembling together a fuse assembly and fuse holder assembly, the method comprising:

inserting a first longitudinal end of the fuse assembly into a first fuse holder component of the fuse holder assembly, wherein the first fuse holder component is of a single, one-piece construction; and connecting a first connector of the first fuse holder component with a second connector of a second fuse holder component after said inserting a first end of the fuse assembly, wherein the second fuse holder component is of a single, one-piece construction, wherein a substantially non-releasable, waterproof connection between the first and second connectors is formed and entirety of the fuse assembly is enclosed in an enclosure defined by the first and second fuse holder components upon said connecting a first connector of the first fuse holder component with a second connector of a second fuse holder component.

16. The method set forth in claim 15, wherein each of the first and second fuse holder components is formed from thermoplastic rubber.

17. The method set forth in claim 16, further comprising:

inserting a first wire into a first wire receiving portion of the first fuse holder component, wherein a portion of the first wire extends outside the first fuse holder component through a second longitudinal end of the first fuse holder component;

connecting the first wire to a first wire connector of the first fuse assembly, wherein the first wire connector is disposed at a first longitudinal end of the fuse;

inserting the second wire into a second wire receiving portion of the second fuse holder component, wherein a portion of the second wire extends outside the second fuse holder component through a second longitudinal end of the second fuse holder component; and connecting the second wire to a second wire connector of the first fuse assembly, wherein the second wire connector is disposed at a second longitudinal end of the fuse.

18. The method set forth in claim 17, wherein said connecting the first wire to a first wire connector of the first fuse assembly comprises crimping said first wire connector over said first wire, and wherein said connecting the second wire to a second wire connector of the second fuse assembly comprises crimping said second wire connector over said second wire.

19. An inline fuse holder assembly for enclosing a fuse assembly including a fuse, and first and second wire connectors at respective first and second longitudinal ends of the fuse assembly, the inline fuse holder assembly comprising:

a first fuse holder component having an open first longitudinal end and a second longitudinal end, the first fuse holder component including a first connector adjacent the first longitudinal end of the first fuse holder component, a first wire receiving portion adjacent the second longitudinal end of the first fuse holder component, and a first body portion intermediate the first connector and the first wire receiving portion, wherein the first fuse holder component defines a first fuse assembly-receiving cavity, extending from the first longitudinal end toward the second longitudinal end and terminating before the first wire sealing portion, for receiving the first longitudinal end of the fuse assembly through the first longitudinal end of the first fuse holder component, wherein the first wire receiving portion is configured for receiving a first wire connectable to the first wire connector when the fuse assembly is received in the fuse assembly-receiving cavity;

a second fuse holder component having an open first longitudinal end and a second longitudinal end, the second fuse holder component including a second connector adjacent the first longitudinal end of the second fuse holder component, a second wire receiving portion adjacent the second longitudinal end of the second fuse holder component, and a second body portion intermediate the second connector and the second wire receiving portion, wherein the second fuse holder component defines a second fuse assembly-receiving cavity, extending from the first longitudinal end toward the second longitudinal end and terminating before the second wire sealing portion, for receiving the second longitudinal end of the fuse assembly through the first longitudinal end of the second fuse holder component, wherein the second wire receiving portion is configured for receiving a second wire connectable to the second wire connector when the fuse assembly is received in the fuse assembly-receiving cavity;

wherein each of the first and second fuse holder components is of a single, one-piece construction of thermoplastic rubber; and wherein at least one of the first and second fuse holder components includes a plurality of internal longitudinal ribs projecting into the corresponding one of the first and second fuse assembly-receiving cavity.

20. A fuse assembly formed as a single unit for use with a fuse holder assembly, the fuse assembly comprising:

a ferrule fuse having opposite first and second longitudinal ends;

a first wire connector at the first longitudinal end of the ferrule fuse for connecting the ferrule fuse to a first wire;

a second wire connector at the second longitudinal end of the ferrule fuse for connecting the ferrule fuse to a second wire; and a substantially waterproof, dielectric outer layer surrounding the ferrule fuse and the first and second wire connectors;

wherein the ferrule fuse includes first and second ferrule terminals, and the first and second wire connectors are crimped onto the respective first and second ferrule terminals and non-releasable connected thereto.

21. The fuse assembly of claim 20, wherein the substantially waterproof, dielectric outer layer comprises heat shrink.

22. A fuse assembly formed as a single unit for use with a fuse holder assembly, the fuse assembly comprising:

a ferrule fuse having opposite first and second longitudinal ends;

a first wire connector at the first longitudinal end of the ferrule fuse for connecting the ferrule fuse to a first wire;

a second wire connector at the second longitudinal end of the ferrule fuse for connecting the ferrule fuse to a second wire; and a substantially waterproof, dielectric outer layer surrounding the ferrule fuse and the first and second wire connectors;

wherein the substantially waterproof, dielectric outer layer comprises heat shrink.

23. A fuse assembly formed as a single unit, the fuse assembly comprising:

a ferrule fuse having opposite first and second longitudinal ends, each of the first and second longitudinal ends provided with a respective first and second ferrule terminal;

a first wire connector at the first longitudinal end of the ferrule fuse for connecting the ferrule fuse to a first wire;

a second wire connector at the second longitudinal end of the ferrule fuse for connecting the ferrule fuse to a second wire; and a substantially waterproof, dielectric outer layer surrounding at least a portion of the ferrule fuse and the first and second wire connectors;

wherein the first and second wire connectors are each non-releasably connected to the respective first and second ferrule terminals.

24. The fuse assembly of claim 23, wherein the substantially waterproof, dielectric outer layer comprises heat shrink.

25. A fuse assembly comprising:

a single pre-assembled unit comprising:

a ferrule fuse having opposite first and second longitudinal ends, each of the first and second longitudinal ends provided with a respective first and second ferrule terminal;

a substantially waterproof, dielectric outer layer surrounding at least a portion of the ferrule fuse;

a first wire connector at the first longitudinal end of the ferrule fuse for connecting the ferrule fuse to a first wire; and a second wire connector at the second longitudinal end of the ferrule fuse for connecting the ferrule fuse to a second wire;

wherein the first and second wire connectors are each non-releasably connected to the respective first and second ferrule terminals.

26. The fuse assembly of claim 25, wherein the substantially waterproof, dielectric outer layer comprises heat shrink.

27. The fuse assembly of claim 25, wherein the substantially waterproof, dielectric outer layer also surrounds at least a portion of the first and second wire connectors.

* * * * *

UNITED STATES PATENT AND TRADEMARK OFFICE

CERTIFICATE OF CORRECTION

PATENT NO. : 8,454,390 B2
APPLICATION NO. : 13/151984
DATED : June 4, 2013
INVENTOR(S) : Matthew Rain Darr, Patrick A. Von Zur Muehlen and Mengxi Zhao It is certified that error appears in the above-identified patent and that said Letters Patent is hereby corrected as shown below:

In the Claims

Column 9, Lines 41-42, in Claim 1, delete "first component" and insert -- first fuse holder component -- therefor.

Column 9, Line 52, in Claim 1, delete "sealing" and insert -- receiving -- therefor.

Column 9, Lines 58-59, in Claim 1, delete "the fuse" and insert -- the first fuse -- therefor.

Column 9, Lines 61-62, in Claim 1, delete "second component" and insert -- second fuse holder component -- therefor.

Column 10, Line 7, in Claim 1, delete "sealing" and insert -- receiving -- therefor.

Column 10, Line 13, in Claim 1, delete "the fuse" and insert -- the second fuse -- therefor.

Column 10, Line 31, in Claim 4, delete "second components" and insert -- second fuse holder components -- therefor.

Column 10, Line 34, in Claim 5, delete "second components" and insert -- second fuse holder components -- therefor.

Column 11, Line 44, in Claim 17, delete "fuse assembly" and insert -- fuse holder component -- therefor.

Column 11, Line 52, in Claim 17, delete "first fuse assembly" and insert -- second fuse holder component -- therefor.

Signed and Sealed this
Twenty-first Day of October, 2014

Michelle K. Lee

Michelle K. Lee
*Deputy Director of the United States Patent and Trademark Office*

Column 11, Lines 56-57, in Claim 18, delete “first fuse assembly” and insert -- first fuse holder component -- therefor.

Column 11, Line 58, in Claim 18, delete “second fuse assembly” and insert -- second fuse holder component -- therefor.

Column 12, Line 10, in Claim 19, delete “sealing” and insert -- receiving -- therefor.

Column 12, Line 16-17, in Claim 19, delete “the fuse” and insert -- the first fuse -- therefor.

Column 12, Line 32, in Claim 19, delete “sealing” and insert -- receiving -- therefor.

Column 12, Line 38, in Claim 19, delete “the fuse” and insert -- the second fuse -- therefor.